US009301041B2

(12) United States Patent
Narayan

(10) Patent No.: US 9,301,041 B2
(45) Date of Patent: Mar. 29, 2016

(54) HEADPHONE DEVICE

(75) Inventor: Renjish Narayan, Ditton (GB)

(73) Assignee: Cirrus Logic International Semiconductor Ltd., Edinburgh (GB)

( * ) Notice: Subject to any disclaimer, the term of this patent is extended or adjusted under 35 U.S.C. 154(b) by 143 days.

(21) Appl. No.: 14/232,834

(22) PCT Filed: Jul. 6, 2012

(86) PCT No.: PCT/GB2012/051590
§ 371 (c)(1),
(2), (4) Date: Feb. 6, 2014

(87) PCT Pub. No.: WO2013/011275
PCT Pub. Date: Jan. 24, 2013

(65) Prior Publication Data

US 2014/0169584 A1 Jun. 19, 2014

Related U.S. Application Data

(60) Provisional application No. 61/532,395, filed on Sep. 8, 2011.

(30) Foreign Application Priority Data

Jul. 15, 2011 (GB) ..... 1112194.4

(51) Int. Cl.
*H04R 1/10* (2006.01)

(52) U.S. Cl.
CPC ..... *H04R 1/1083* (2013.01)

(58) Field of Classification Search
None
See application file for complete search history.

(56) References Cited

U.S. PATENT DOCUMENTS

| | | | | |
|---|---|---|---|---|
| 5,729,605 | A * | 3/1998 | Bobisuthi et al. | 379/430 |
| 7,092,745 | B1 | 8/2006 | D'Souza | |
| 2006/0254852 | A1 | 11/2006 | Chen | |
| 2008/0247588 | A1 | 10/2008 | Yang | |
| 2009/0147981 | A1 * | 6/2009 | Blanchard et al. | 381/380 |

FOREIGN PATENT DOCUMENTS

| | | | |
|---|---|---|---|
| GB | 2 445 388 | A | 7/2008 |
| GB | 2 454 605 | A | 5/2009 |
| WO | WO 97/00592 | A2 | 1/1997 |

* cited by examiner

*Primary Examiner* — Brenda Bernardi
(74) *Attorney, Agent, or Firm* — Jackson Walker L.L.P.

(57) ABSTRACT

A headphone comprises a speaker. The rear volume of the speaker is coupled to a mixing volume, the front volume of the speaker is coupled to the mixing volume, and the mixing volume is coupled to the exterior. The acoustic impedances resulting from the rear volume, the front volume, the mixing volume, and the passages between them can be adjusted, in order to achieve the desired sound egress properties. Acoustic damping material can be included in the various leakage paths in order to achieve the desired properties, depending on the type of speaker to be used, the acoustic design of the headphone, the mechanical properties of the headphone body, and the desired frequency response characteristics of the headphone.

17 Claims, 7 Drawing Sheets

HEADPHONE DEVICE

This invention relates to a headphone device, for example of the type that can be worn on the ear(s) of a user, or of the type that can be worn in the ear(s) of a user. Thus, the invention relates to any ear-worn speaker-carrying device.

GB-2445388A discloses a headphone device, having a cushion that can be placed on the user's ear, and in which the front surface of the speaker is vented to the exterior by a front leakage path, while the rear surface of the speaker is vented to the exterior by a rear leakage path.

In such a device, the presence of the leakage paths means that the poor frequency responses associated with closed-type headphones can be avoided. However, there is a potential disadvantage, in that the sounds generated by the speaker can be heard outside the headphone. GB-2445388A discloses a system in which the front leakage path and the rear leakage path have adjacent outlet ports, so that there is a degree of acoustic wave cancellation between the sounds passing along the leakage paths, with the result that the total level of sound egress is reduced.

According to a first aspect of the present invention, there is provided a headphone, comprising a speaker, wherein:

- the rear volume of the speaker is coupled to a mixing volume,
- the front volume of the speaker is coupled to the mixing volume, and
- the mixing volume is coupled to the exterior.

The rear volume may be coupled to the mixing volume through a passage containing an acoustic damping material; the front volume may be coupled to the mixing volume through a passage containing an acoustic damping material; and/or the mixing volume may be coupled to the exterior through a passage containing an acoustic damping material.

The rear volume may be coupled to the mixing volume through a first passage; the front volume may be coupled to the mixing volume through a second passage; and the mixing volume may be coupled to the exterior through a third passage; and the third passage may then have a smaller cross-sectional area than the first or second passage.

The mixing volume may be smaller than the rear volume, for example, less than 50% of the rear volume, less than 25% of the rear volume, less than 10% of the rear volume, or less than 5% of the rear volume.

The speaker may have a circular cross-section, and the mixing volume may then extend continuously around the circumference of the speaker, or part way around the circumference of the speaker.

The headphone may be in the form of an on-the-ear headphone, an in-the-ear headphone, or an earbud-type headphone.

According to a second aspect of the invention, there is provided an audio system, comprising:

- an audio source; and
- a headphone in accordance with the first aspect.

According to a third aspect of the invention, there is provided a method of preventing sound egress from a headphone, the method comprising:

- mounting a speaker in the headphone;
- forming a rear sound leakage path from a rear volume of the speaker to a mixing volume,
- forming a front leakage path from a front volume of the speaker to the mixing volume, and
- forming an outlet passage from the mixing volume to the exterior.

For a better understanding of the present invention, and to show how it may be put into effect, reference will now be made, by way of example, to the accompanying drawings, in which.

Figure 1:
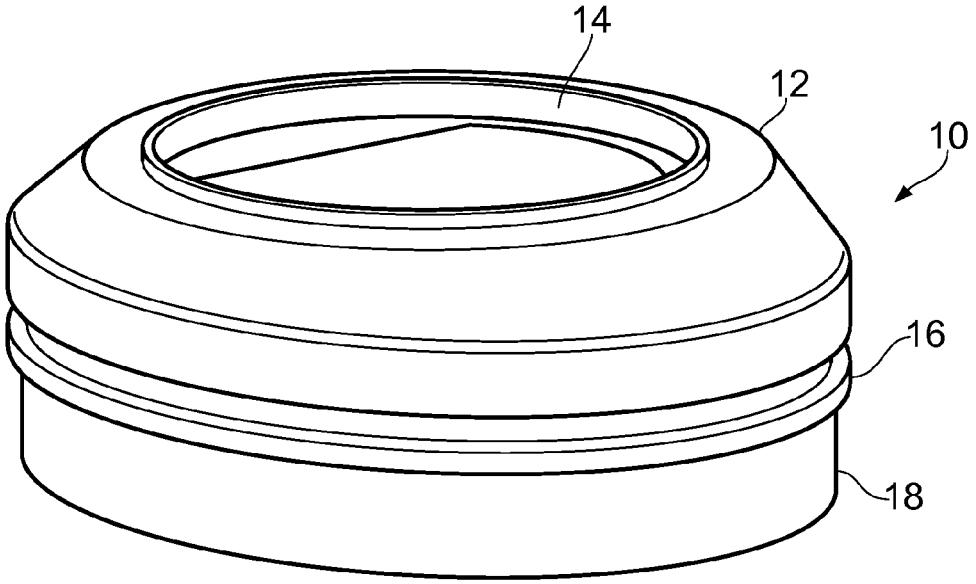
FIG. 1 is a perspective view, showing a headphone in accordance with an embodiment of the invention.

FIG. 1 shows a headphone 10. Although only one headphone is shown in FIG. 1, the headphone will typically be one of a pair of headphones, connected for example by a band. FIG. 1 shows a supra-aural, or an on-the-ear, type headphone, of a size that allows it to be placed on the ear of a user, for example with a diameter in the region of 50-100 mm. However, the description herein applies equally to circumaural headphones, having a housing that is larger than the user's outer ear, and having a cushion that can be located around the outer ear against the side of the user's head, to in-the-ear type headphones, having a diameter in the region of 10-20 mm, that are intended to be placed in the outer ear of the user, and to earbud type headphones, having a diameter of less than 10 mm, that are intended to be placed in the entrance to the user's ear canal.

FIG. 1 shows an upper body part 12 of the headphone 10, having a hole 14 for mounting a band or the like for connecting the headphone 10 to the other headphone of the pair. FIG. 1 also shows a lower body part 16 of the headphone, to which is connected a circumferentially extending cushion 18, intended to sit on the user's ear.

The headphone can form part of a larger audio system, including an audio source device, for example in the form of a mobile phone handset, a games console, a radio receiver or a recorded sound source such as an MP3 player. The headphone then typically has a jack for insertion into a socket on the source device.

Figure 2:
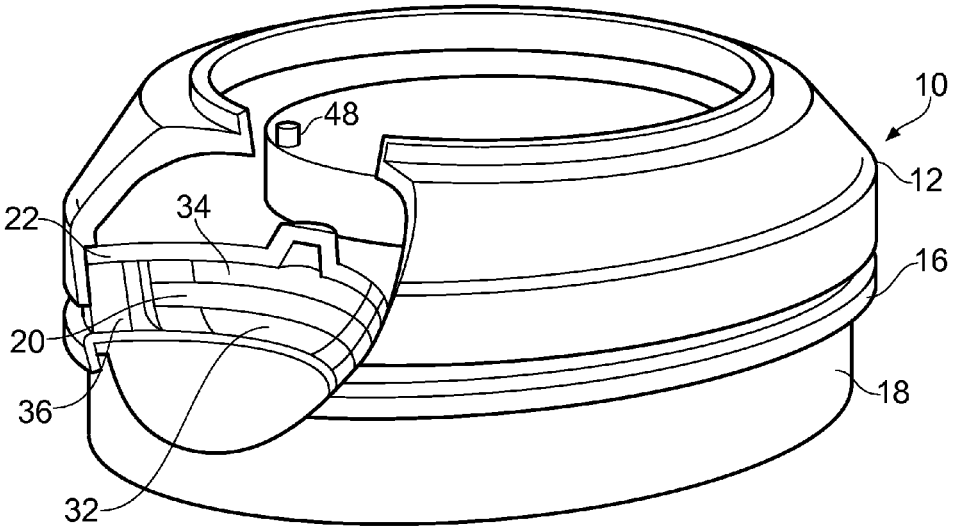
FIG. 2 is a partially cut away perspective view, showing a part of the interior of the headphone of FIG. 1.
Figure 3:
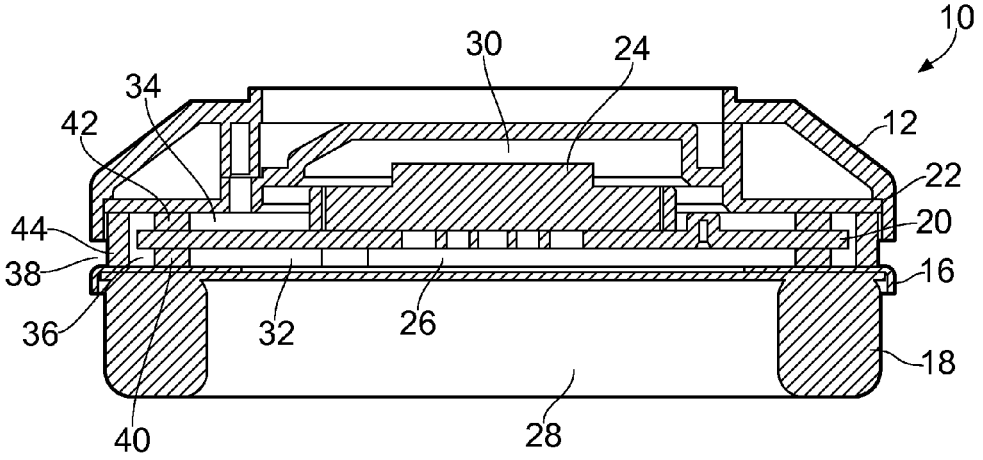
FIG. 3 is a cross-sectional view through the headphone of FIG. 1.

FIG. 2 is a partially cutaway view of the headphone 10, while FIG. 3 is a cross-sectional view through the headphone 10.

Thus, FIGS. 2 and 3 also show the upper body part 12, the lower body part 16 and the cushion 18.

Located within the headphone 10 are a speaker plate 20 and a back plate 22.

The speaker 24 (which can be of any type, and can for example be entirely conventional, and is therefore not shown in detail) is mounted to the speaker plate 20.

Electrical connections (not shown) are provided to the speaker 24, and electrical signals can then be passed to the speaker, causing it to generate sound, which, when the headphone is in position on the ear of a user, is directed through the central hole in the cushion 18 to the ear of the user.

The space 26 immediately in front of the speaker 24, and the space 28 surrounded by the cushion 18, as well as any additional space in the outer ear of the user, together form a front volume of the speaker.

The space 30 between the rear of the speaker 24 and the back plate 22 forms a rear volume of the speaker.

In order to avoid the effects produced by a sealed headphone, it is advantageous for the front volume and the rear volume of the loudspeaker to be connected to the exterior, even when the headphone is worn relatively tightly on the ear of the user in such a way that the cushion 18 forms a good seal on the ear.

Therefore, in this illustrated embodiment, a front leakage path 32 extends radially outwards from the front volume of the speaker all around the circumference. Similarly, a rear leakage path 34 extends radially outwards from the rear volume 30 of the speaker all around the circumference. In other embodiments, the front and rear leakage paths do not extend all around the circumference.

The front leakage path 32 and the rear leakage path 34 both lead to a mixing volume 36. The mixing volume 36 leads to the exterior through an outlet passage 38.

Thus, in this illustrated embodiment, the mixing volume 36 is located radially outwardly of the speaker 24, around the circumference thereof, within the headphone. In particular in the case of embodiments in which the front and rear leakage paths do not extend all around the circumference of the speaker 24, the mixing volume 36 similarly may not extend all around the circumference of the speaker 24. It is also possible to position the mixing volume so that it is not located radially outwardly of the speaker 24.

In this illustrated embodiment, the mixing volume 36 is located at a height that overlaps the position of the speaker 24. However, the mixing volume 36 can be located either above or below the position of the speaker 24.

In this illustrated embodiment, the outlet passage 38 has a cross-sectional area that is smaller than the cross-sectional area of the front leakage path 32 and also smaller than the cross-sectional area of the rear leakage path 34. In other embodiments, the cross-sectional area of the outlet passage 38 is larger than, or equal in size to, the cross-sectional areas of the front leakage path 32 and the rear leakage path 34, which, in turn, may be equal or different.

In this illustrated embodiment, the mixing volume is smaller than the rear volume, for example less than 50% of the size of the rear volume, less than 25% of the size of the rear volume, less than 10% of the size of the rear volume, or less than 5% of the size of the rear volume.

In the illustrated embodiment, the mixing volume takes the form of an identifiable chamber 36. In other embodiments, the mixing volume is the volume at the points where the front leakage path and the rear leakage path merge, and form the start of the outlet passage.

First acoustic damping material 40 is located in the front leakage path 32 between the front volume 26, 28 and the mixing volume 36. Second acoustic damping material 42 is located in the rear leakage path 34 between the rear volume 30 and the mixing volume 36. Third acoustic damping material 44 is located in the outlet passage 38 between the mixing volume 36 and the exterior. The damping material can for example be polyurethane foam or fabric mesh.

As the diaphragm of the speaker moves, it alternately compresses and rarefies the air in the front volume and the rear volume of the speaker. The presence of the mixing volume allows the sound from the front volume to mix with, and partially cancel, the sound from the rear volume.

Thus, the headphone reduces sound egress, in particular at low to medium frequencies, for example in the range between 500 Hz to 3 kHz.

The headphone 10 may be used in an ambient noise reduction system. Thus, at least one microphone 48 can be positioned such that it can detect ambient sounds. Signal processing circuitry, located in the headphone, or in a device that is acting as a source of sounds, can then apply analogue or digital signal processing to the detected ambient sounds, in order to generate a noise cancellation signal, which can be passed to the speaker, in order to generate sounds that at least partially cancel the ambient sounds.

Figure 4:
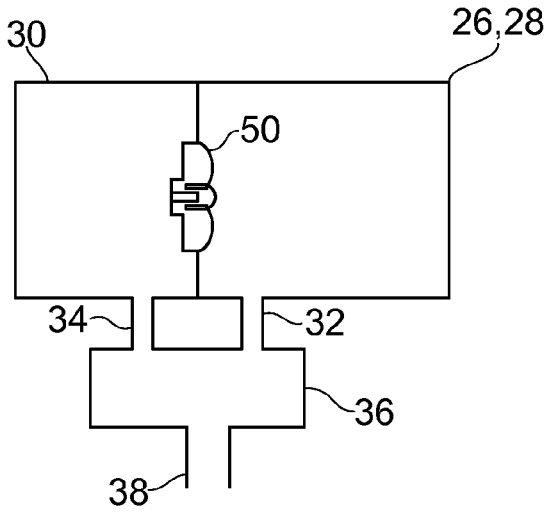
FIG. 4 shows the acoustic impedances in the headphone of FIG. 1.

FIG. 4 illustrates the acoustic impedances that arise in the headphone of FIGS. 1-3. A volume is equivalent to a capacitance, a tube is equivalent to an inductance, and an acoustic damping material is equivalent to an electrical resistance. Thus, FIG. 4 shows the speaker 50, which acts as a piston, or pressure source, with a particular volume velocity, located between the front volume 26, 28 and the rear volume 30, with the front volume 26, 28 connected to the mixing volume 36 through a front leakage path 32, the rear volume 30 connected to the mixing volume 36 through a rear leakage path 34, and the mixing volume 36 connected to the exterior through an outlet passage 38.

Figure 5:
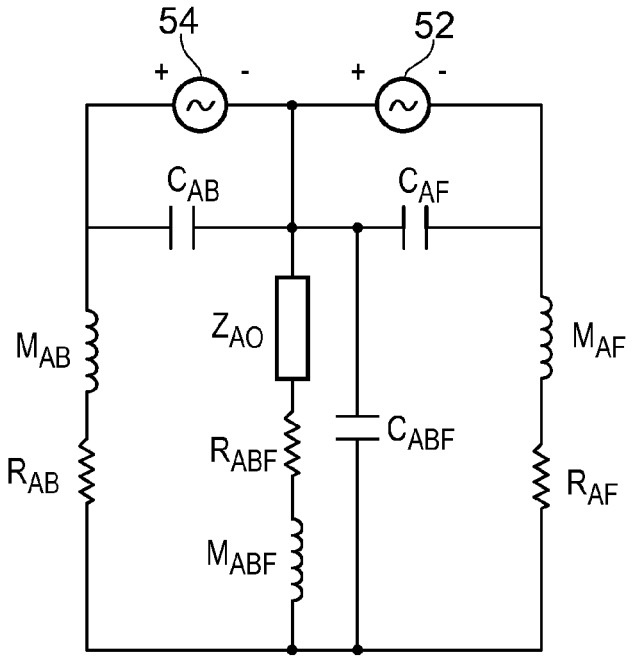
FIG. 5 shows a first impedance equivalent circuit referred to the acoustic domain.
Figure 6:
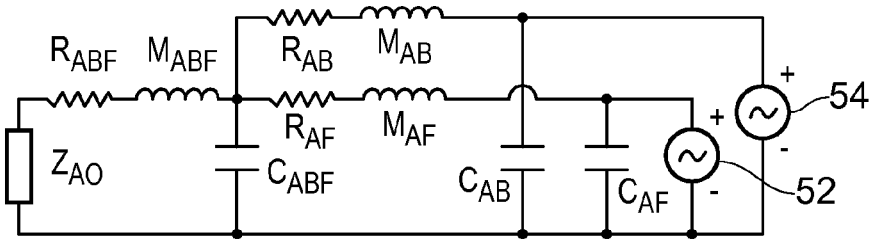
FIG. 6 shows a second impedance equivalent circuit referred to the acoustic domain.

FIGS. 5 and 6 show alternative possible forms of the equivalent electrical circuit, with the speaker 50 acting both as a first electrical source 52 that drives the front volume, and as a second electrical source 54 that drives the rear volume out of phase with the first electrical source 52. The front volume 26, 28 and rear volume 30 act as acoustic capacitances $C_{AF}$ and $C_{AB}$ respectively, the front leakage path 32 has a resistance $R_{AF}$ and inductance $M_{AF}$, the rear leakage path 34 has a resistance $R_{AB}$ and inductance $M_{AB}$, the mixing volume 36 acts as an acoustic capacitance $C_{ABF}$, and the outlet passage 38 has a resistance $R_{ABF}$ and inductance $M_{ABF}$. The acoustic impedance seen by the leak from the outlet passage 38 is designated $Z_{AO}$.

Analysis of the impedance equivalent circuit allows a designer to tailor the parameters that can be adjusted, in order to achieve the desired sound egress properties. For example, the designer might have fixed values for the front and rear volumes, based on the design of the headphone, but might have freedom as to the type or amount of acoustic damping material to be included in the various leakage paths (or other parameters), and can then adjust these types and amounts in order to achieve the desired properties. The parameters will also depend to a certain extent on the type of speaker to be used, acoustic design of the particular headphone, the mechanical properties of the headphone body, and the desired frequency response characteristics of the headphone.

The sound egress properties of the headphone are determined to some extent by the amount of sound cancellation that takes place in the mixing volume. The speaker causes changes in the sound pressure in the front and rear volumes that are of opposite polarity. That is, while the speaker is moving so as to increase the sound pressure in the front volume, it is decreasing the sound pressure in the rear volume, and vice versa. The acoustic impedances in the front and rear leakage paths then cause phase shifts in these variations, and the most effective sound cancellation can take place if the sounds in the front and rear leakage paths are out of phase at a particular frequency range when they reach the mixing chamber.

Figure 7:
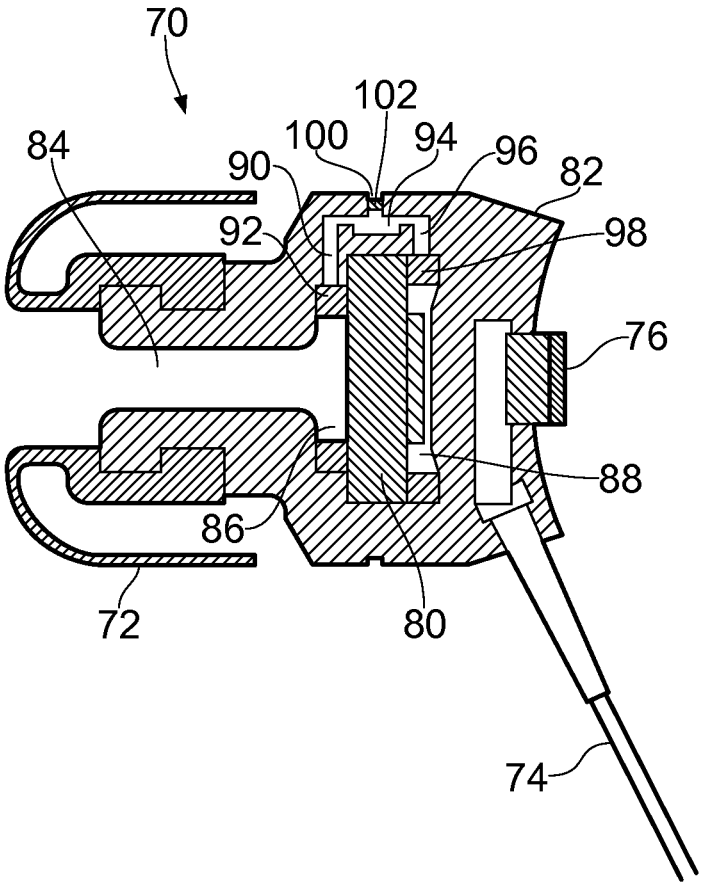
FIG. 7 shows a headphone in accordance with another embodiment of the invention.

FIG. 7 shows a further embodiment, in which the headphone takes the form of an earbud 70, intended to be inserted into the outer part of the ear canal of the user. A thin rubber flange 72 is located around a front part of the earbud 70, such that it can make a seal in the user's ear canal when the earbud is in use. A connecting cable 74 can be connected to a device such as a phone or a music player. A microphone 76 is located at the rear side of the headphone 70, for detecting ambient sounds, so that the ambient noise signal can be used to generate a noise cancellation signal, which can be played through the headphone to reduce the ambient noise perceived by the user.

A speaker 80 is mounted in the body 82 of the headphone, and generates sounds that pass along a primary outlet 84 towards the inner ear of the user.

The passage 84, and the space 86 in front of the speaker 80 together form a front volume of the speaker. The space 88 behind the speaker 80 forms the rear volume of the speaker.

The front volume 84, 86 has a front sound leakage path 90, containing a front damping washer 92, and connected to a mixing volume 94 that is located around one part of the speaker 80. The rear volume 88 has a rear sound leakage path 96, containing a rear damping washer 98, that is also connected to the mixing volume 94.

The mixing volume 94 is connected to the exterior through an outlet passage 100 that also contains acoustic damping material 102.

Figure 8:
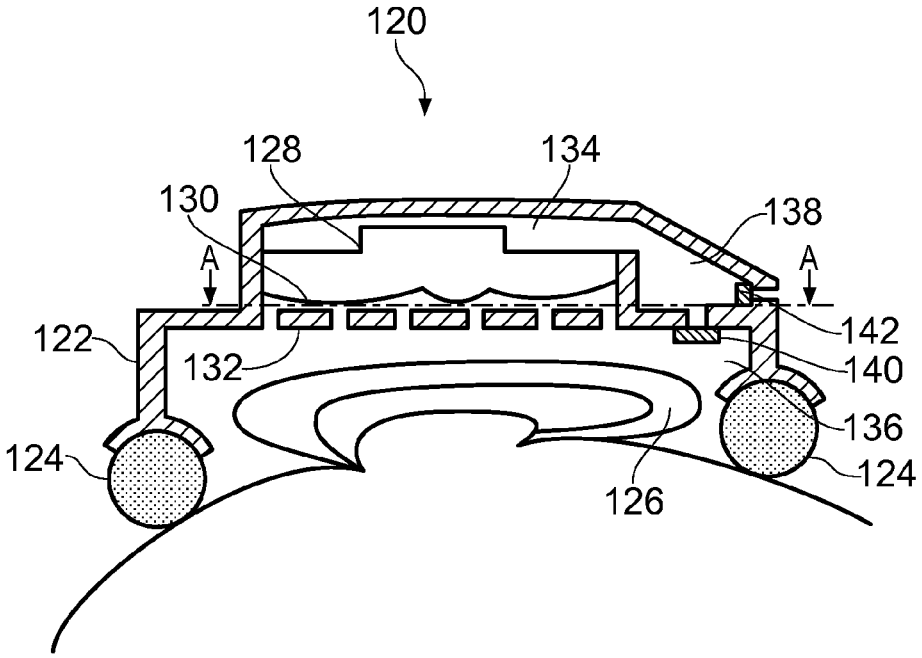
FIG. 8 is a cross-sectional view through an alternative headphone.

FIG. 8 is a vertical cross-sectional view through a headphone 120 in accordance with a further embodiment. The headphone 120 is a circumaural headphone, having a housing 122 that is larger than the user's outer ear, and having a generally circular cushion 124 that can be located around the outer ear 126 against the side of the user's head.

The headphone 120 includes a speaker 128, which is generally conventional in form, and has a diaphragm 130. The front of the speaker 128 is covered in a sound permeable layer 132, which protects the diaphragm while allowing sound to pass into the wearer's ear.

The space behind the speaker 128, within the casing 122, forms a rear volume 134 of the speaker 128. The space enclosed by the speaker 128, the casing 122, the cushion 124 and the wearer's head forms a front volume 136 of the speaker 128.

Figure 9:
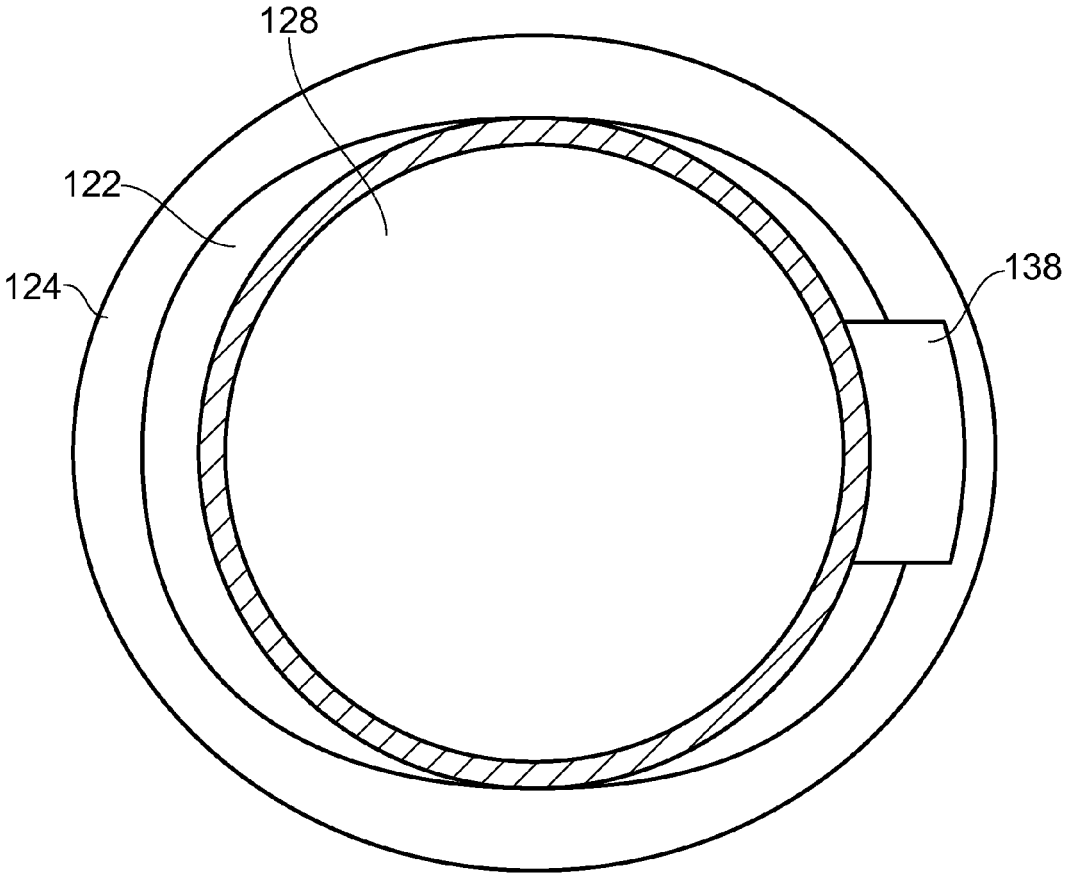
FIG. 9 is a cross-sectional plan view of the headphone of FIG. 8.

The rear volume 134 is connected to a mixing volume 138, which is located within the casing 122 radially outwardly of the speaker 128 though only around a small part of the circumference thereof. FIG. 9 is a horizontal cross-sectional view through the headphone 120, along the line A-A in FIG. 8, and shows clearly the position of the mixing volume 138.

The front volume 136 is also connected to the mixing volume 138. As shown in FIG. 8, the mixing volume is located above one section of the outer part of the front volume 136. As also shown in FIG. 8, the front volume 136 is connected to the mixing volume 138 through a passage that is covered by an acoustic mesh 140 that controls the degree of sound leakage from the front volume 136 to the mixing volume 138.

As also shown in FIG. 8, the mixing volume 138 is connected to the exterior through a hole in the casing 122 that is also covered by an acoustic mesh 142 in order to control the degree of sound leakage from the mixing volume 138 to the exterior.

Thus, as described previously, the mixing volume allows the sounds passing to the exterior from the front and rear volumes to mix together before passing to the exterior.

Thus, there is provided a headphone of the earbud type, in which leakage paths are provided so that the frequency response characteristics of the headphone are acceptable, but in which the sound egress is reduced.

The invention claimed is:

1. A headphone, comprising a speaker, wherein:

the rear volume of the speaker is coupled to a mixing volume through a first passage, the front volume of the speaker is coupled to the mixing volume through a second passage, and the mixing volume is coupled to the exterior through a third passage, wherein the third passage has a smaller cross-sectional area than the first or second passage.

2. A headphone as claimed in claim 1, wherein the rear volume is coupled to the mixing volume through a passage containing an acoustic damping material.

3. A headphone as claimed in claim 1, wherein the front volume is coupled to the mixing volume through a passage containing an acoustic damping material.

4. A headphone as claimed in claim 1, wherein the mixing volume is coupled to the exterior through a passage containing an acoustic damping material.

5. A headphone as claimed in claim 1, wherein the mixing volume is smaller than the rear volume.

6. A headphone as claimed in claim 5, wherein the mixing volume is less than 50% of the rear volume.

7. A headphone as claimed in claim 6, wherein the mixing volume is less than 25% of the rear volume.

8. A headphone as claimed in claim 7, wherein the mixing volume is less than 10% of the rear volume.

9. A headphone as claimed in claim 8, wherein the mixing volume is less than 5% of the rear volume.

10. A headphone as claimed in claim 1, wherein the mixing volume is located within the headphone radially outwardly of the speaker.

11. A headphone as claimed in claim 10, wherein the speaker has a circular cross-section, and the mixing volume extends continuously around the circumference of the speaker.

12. A headphone as claimed in claim 10, wherein the speaker has a circular cross-section, and the mixing volume extends part way around the circumference of the speaker.

13. A headphone as claimed in claim 1, in the form of an on-the-ear headphone.

14. A headphone as claimed in claim 1, in the form of an in-the-ear headphone.

15. A headphone as claimed in claim 1, in the form of an earbud-type headphone.

16. An audio system, comprising:

an audio source; and a headphone, the headphone comprising a speaker, wherein:

the rear volume of the speaker is coupled to a mixing volume through a first passage, the front volume of the speaker is coupled to the mixing volume through a second passage, and the mixing volume is coupled to the exterior through a third passage, wherein the third passage has a smaller cross-sectional area than the first or second passage.

17. A method of preventing sound egress from a headphone, the method comprising:

mounting a speaker in the headphone;

forming a rear sound leakage path from a rear volume of the speaker to a mixing volume, forming a front leakage path from a front volume of the speaker to the mixing volume, and forming an outlet passage from the mixing volume to the exterior, wherein the outlet passage has a smaller cross-sectional area than the rear sound leakage path or the front leakage path.

* * * * *